US005784809A

United States Patent [19]

McDonald

[11] Patent Number: 5,784,809

[45] Date of Patent: *Jul. 28, 1998

[54] SNOWBOARDING BOOT

[75] Inventor: Steven C. McDonald, Portland, Oreg.

[73] Assignee: The Burton Corporation, Burlington, Vt.

[ * ] Notice: This patent issued on a continued prosecution application filed under 37 CFR 1.53(d), and is subject to the twenty year patent term provisions of 35 U.S.C. 154(a)(2).

[21] Appl. No.: 585,186

[22] Filed: Jan. 8, 1996

[51] Int. Cl.[6] ..... A43B 5/04

[52] U.S. Cl. ..... 36/117.5; 36/115

[58] Field of Search ..... 36/115, 114, 30 R, 36/31, 32 R, 68, 69, 117.5

[56] References Cited

U.S. PATENT DOCUMENTS

| | | | |
|---|---|---|---|
| D. 325,663 | 4/1992 | Barret et al. . | |
| D. 347,318 | 5/1994 | Avar . | |
| 4,262,435 | 4/1981 | Block . | |
| 4,307,521 | 12/1981 | Inohara et al. . | |
| 4,366,634 | 1/1983 | Giese et al. . | |
| 4,557,059 | 12/1985 | Misevich et al. . | |
| 4,777,738 | 10/1988 | Giese et al. | 36/59 C |
| 4,791,736 | 12/1988 | Phillips . | |
| 5,113,599 | 5/1992 | Cohen et al. | 36/29 X |
| 5,131,173 | 7/1992 | Anderié . | |
| 5,177,884 | 1/1993 | Rullier . | |
| 5,224,279 | 7/1993 | Agnew . | |
| 5,367,791 | 11/1994 | Gross et al. . | |
| 5,400,527 | 3/1995 | Marega et al. | 36/117.3 |
| 5,416,988 | 5/1995 | Potter et al. | 36/71 X |
| 5,423,135 | 6/1995 | Poole et al. | 36/59 C |
| 5,446,976 | 9/1995 | Donnadieu et al. . | |

FOREIGN PATENT DOCUMENTS

| | | |
|---|---|---|
| 399 637 B | 6/1995 | Austria . |
| 0 142 677 A1 | 5/1985 | European Pat. Off. . |
| 0 556 799 A1 | 8/1993 | European Pat. Off. . |
| 28 36 793 | 3/1980 | Germany . |
| 6-52503 | 7/1994 | Japan . |
| 7-303728 | 11/1995 | Japan . |
| 3019932 | 1/1996 | Japan . |
| WO 83/04166 | 12/1983 | WIPO . |
| 95/09035 | 4/1995 | WIPO . |

*Primary Examiner*—Ted Kavanaugh

*Attorney, Agent, or Firm*—Wolf, Greenfield & Sacks, P.C.

[57] ABSTRACT

A snowboarding boot with an improved sole construction comprises an upper that engages a two-piece sole. The sole includes a outer sole formed from a resilient rubber-like material that can include treads along the bottom. A midsole constructed from a lightweight, semi-rigid materials, such as ethyl vinyl acetate is joined to the outer sole. The outer sole includes side walls that typically wrap around the toe section of the boot and that taper away toward the heel section. The midsole includes sidewalls that extend upwardly along the upper at the heel section and that join with the sidewalls of the outer sole along a sloped seam line. The midsole sidewalls provide good lateral support to the heel section of the boot, while maintaining a lightweight construction.

19 Claims, 5 Drawing Sheets

SNOWBOARDING BOOT

FIELD OF THE INVENTION

The present invention relates generally to a snowboarding boot and more particularly to a snowboarding boot having an improved sole construction.

BACKGROUND OF THE INVENTION

The popularity of snowboarding increases substantially each year. As the sport's popularity has grown, so has the need for refined, high-performance equipment. One of the most important pieces of snowboarding equipment is the snowboarding boot which should be comfortable, lightweight, sturdy and provide a good "feel" of the board. The feel, or feedback, that the rider receives from the board as it traverses terrain allows for improved control in a variety of conditions.

Prior art snowboard boots have typically consisted of a flexible rubber sole with treads connected to a cloth and/or leather upper. An inner bladder or boot is also typically provided for a snug fit and insulation from cold.

A disadvantage of such prior art boot constructions is that the flexible rubber outer sole adds weight. Unless it includes thick sidewalls, it also may lack lateral stability. This stability is important, particularly in the heel area if the rider is to maintain proper control of the board. In addition, the rubber outer sole of prior art boots generally requires a separate midsole formed from a soft foam material, such as urethane, nested within the sidewalls of the rubber outer sole. This arrangement is typically termed a "up-sole" design. A disadvantage of the fully nested midsole is that it adds further variations in the boot's interior dimensions that could affect the snugness of the fit while still requiring the use of an outer sole with heavy sidewalls for strength. This nested midsole also requires sewing to secure it to the outer sole, thus adding to water leakage.

It is, therefore, an object of this invention to provide a snowboarding boot with an improved sole construction having lower weight, while maintaining the same or better lateral stiffness than an all-rubber "cup-sole" boot. The boot should be sturdy, have long life and be manufactureable using mass-production techniques.

SUMMARY OF THE INVENTION

A snowboarding boot according to this invention overcomes the limitations of the prior art by providing a two-piece sole construction in which the front half of the boot remains flexible by employing a soft pliable outer sole material, such as rubber, with outer sole sidewalls only in the front "toe" half of the boot. The rear half of the boot is lightened by using a more-rigid lightweight midsole formed from a material such as ethyl vinyl acetate—EVA. The midsole is formed with integral sidewalls that surround the heel section.

According to a preferred embodiment, a snowboarding boot includes an upper and a sole section joined to the upper. The sole section includes a toe section and a heel section. The sole has a resilient outer sole that extends substantially from the toe section to the heel section. A midsole is provided. This midsole is constructed from a semi-rigid cushioning material, such as ethyl vinyl acetate—EVA. The midsole is joined to the outer sole and includes sidewalls that extend upwardly around the heel section in engagement with the upper.

The outer sole typically includes sidewalls adjacent to the toe section that also extend upwardly in engagement with the upper. The sidewalls of the outer sole and the sidewalls of the midsole join with each other along a seam line that forms a substantially outer surface between the sidewalls of the midsole and the sidewalls of the outer sole. The seam line is located at the midpoint of the sole. The midsole includes a flattened base for supporting the foot. This base has a thickness that decreases in a direction taken from the heel section to the toe section. The outer sole can comprise rubber with treads. The snowboarding boot according to this invention is specifically arranged to engage a snowboard binding system that engages the upper and the sole. The midsole, according to a preferred embodiment, is free of stitching to provide a more waterproof seal.

A method for constructing a snowboarding boot according to a preferred embodiment comprises providing a resilient outer sole that can consist of rubber with bottom treads. A midsole, constructed from a semi-rigid, lightweight material, such as EVA, is adhered using, preferably, an adhesive, to the outer sole. This adhering step includes locating at least a portion of the midsole so that portion extends upwardly away from the outer sole in the form of sidewalls. These sidewalls are typically located at the heel section of the sole. An upper is adhered to the outer sole and to the midsole. The adhering of the midsole to the upper and the outer sole is generally performed free of stitching. Thus, a more water resistant joint is formed.

BRIEF DESCRIPTION OF THE DRAWINGS

The foregoing and other objects and advantages of the invention will become more clear with reference to the following detailed description of the preferred embodiments as illustrated by the drawings in which.

is

DETAILED DESCRIPTION OF THE PREFERRED EMBODIMENT

Figure 1:
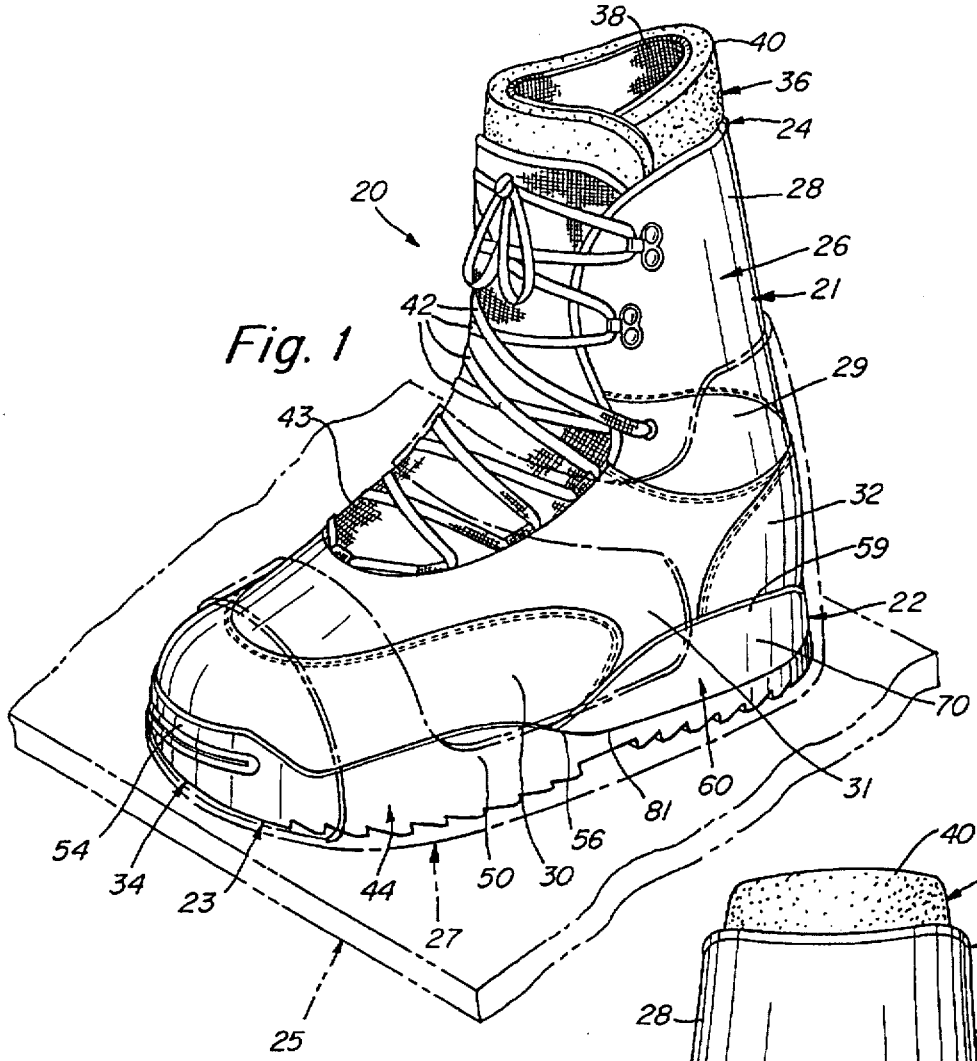
FIG. 1 is a perspective view of a snowboarding boot according to this invention.
Figure 2:
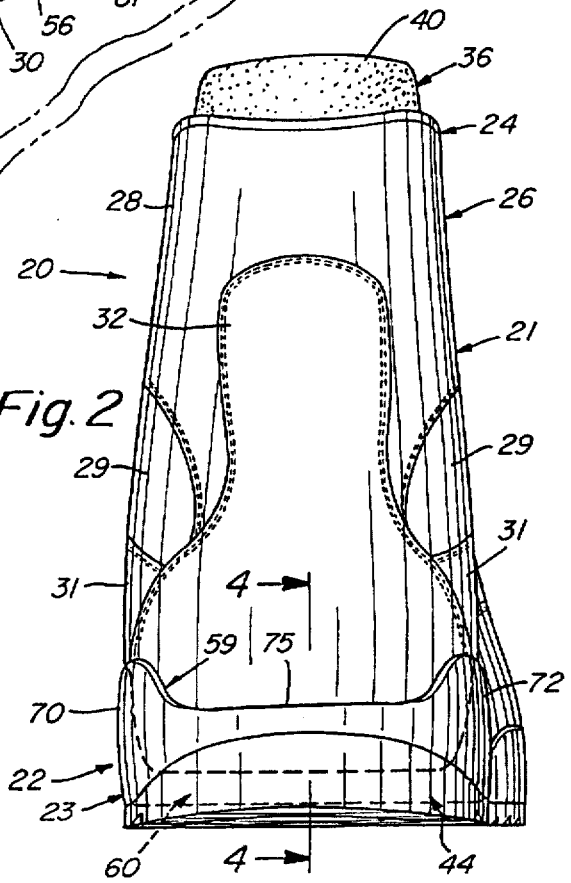
FIG. 2 is a rear view of a snowboarding boot according to this invention.
Figure 3:
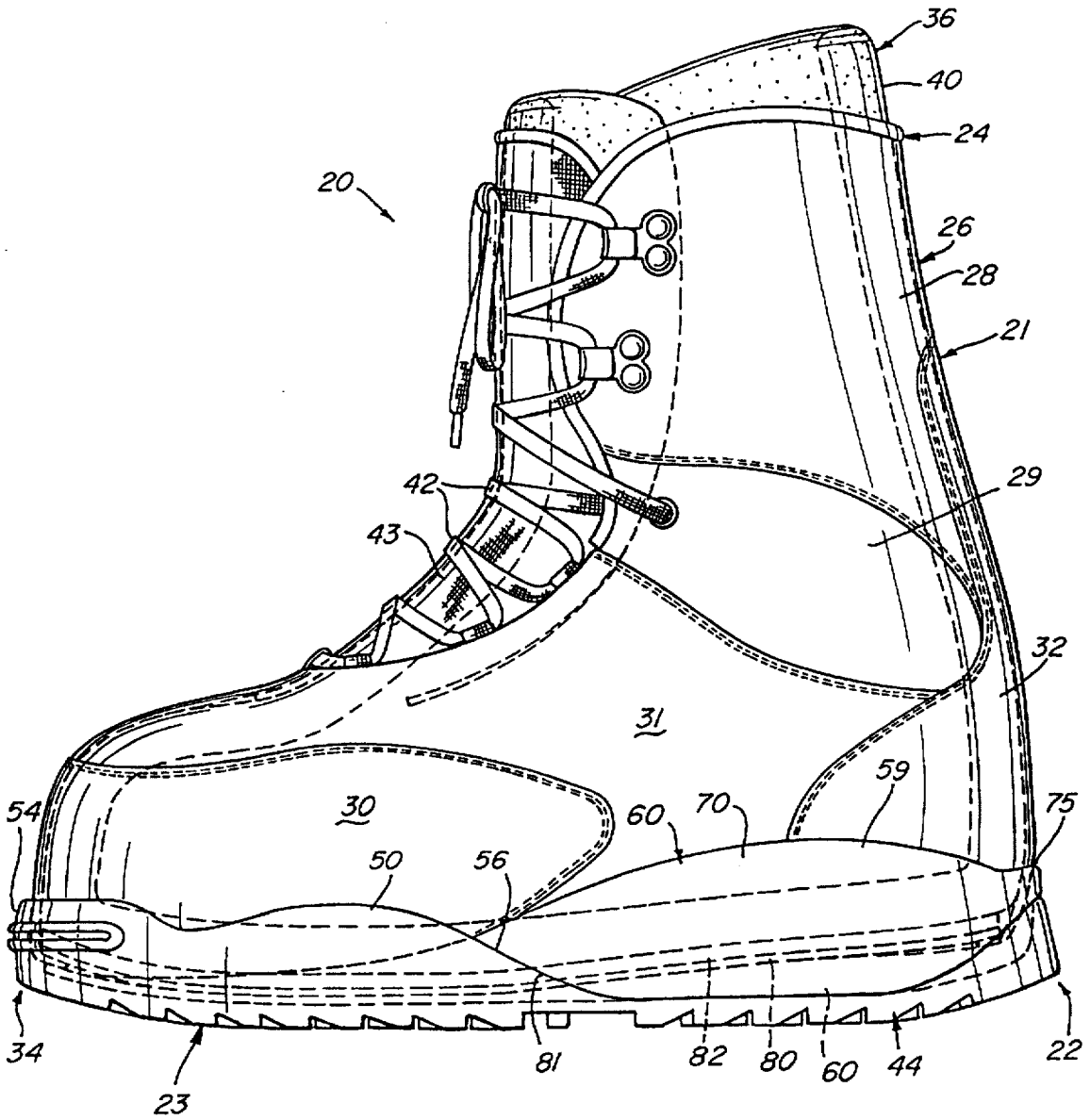
FIG. 3 is a side view of a snowboarding boot according to this invention with internal details shown in phantom.

FIGS. 1–3 show, generally, a snowboarding boot 20 according to this invention. The snowboarding boot 20 is sized and shaped to conform to a specialized binding system. A conventional snowboarding binding system 27 is shown in phantom, schematically in FIG. 1. The binding system is attached to a snowboard top 25, shown partially. The boot 20 includes an upper 21 according to this embodiment, constructed to extend from the sole 23 to an upper rim 24. The upper 21 is arranged to wrap securely around the rider's foot and ankle. The outer shell 26 of the upper 21 is generally constructed from a combination of durable fabric such as canvas or, preferably, Cordura®. Portions of the upper 21 are reinforced by further layers of natural/synthetic cowhide, vinyl or leather. This leather can consist of new buck leather or polyurethane "PU" new buck. The leather portions 28, 30, 31 and 32 can be located where added stiffness or strength is desired such as the toe section 34. The cloth sections 29 are generally positioned where flexure is desired. The exact placement and outline of the leather and fabric sections are generally dictated by taste and style, however. Although an upper 21 according to the preferred embodiment has been shown and described, any snowboarding boot upper can be utilized in connection with the sole according to this invention.

Within the outer shell 26 is located an inner bladder or boot 36 formed, generally, from a polyurethane foam with a soft inner layer 38 and a waterproof outer layer 40. The upper 21 is secured tightly to the rider's foot by laces 42 of somewhat conventional design. A padded fabric tongue 43 bears the bladder 36 when the laces are tightened.

Figure 4:
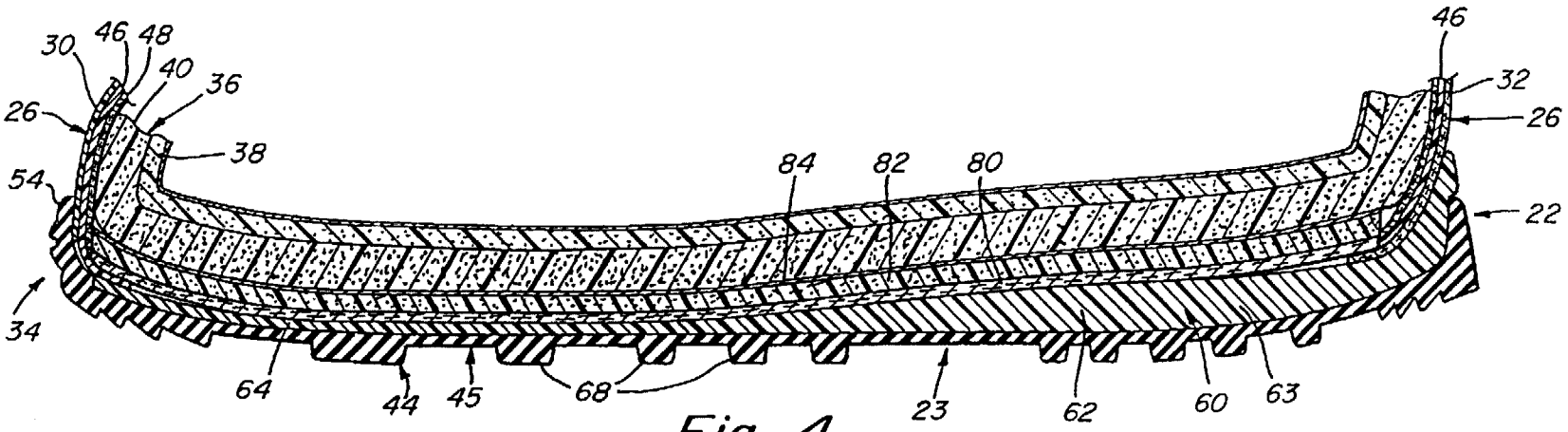
FIG. 4 is a partial side cross-section of the snowboarding boot taken along line 4—4 of FIG. 2.

With specific reference to FIGS. 3 and 4, the upper 21 engages the rubber outer sole 44 at the toe section 34. Adjacent this location, the upper is formed in three layers. The outer layer 30, as described above, is generally composed of leather or vinyl of a stiff, rugged material. At the toe section 34, the leather or vinyl 30 is secured to the sole 23 by an adhesive. The adhesive is chosen based upon its waterproof properties, resilience and strength. In this embodiment a contact adhesive is used. This adhesive can comprise a polyurethane or methy ethyl ketone-based glue such as Barge™ cement. It is usually applied to both parts, heat dried and the parts are then joined by a press fit.

The upper 21 further includes a conventional internal plastic stiffener 46 and an inner liner of cloth or leather 48. The plastic stiffener 46 can be located around the entire boot or can be positioned selectively where further stiffness is desired. It is formed from flat sheet stock that is heated to mold it into a final shape.

Figure 5:
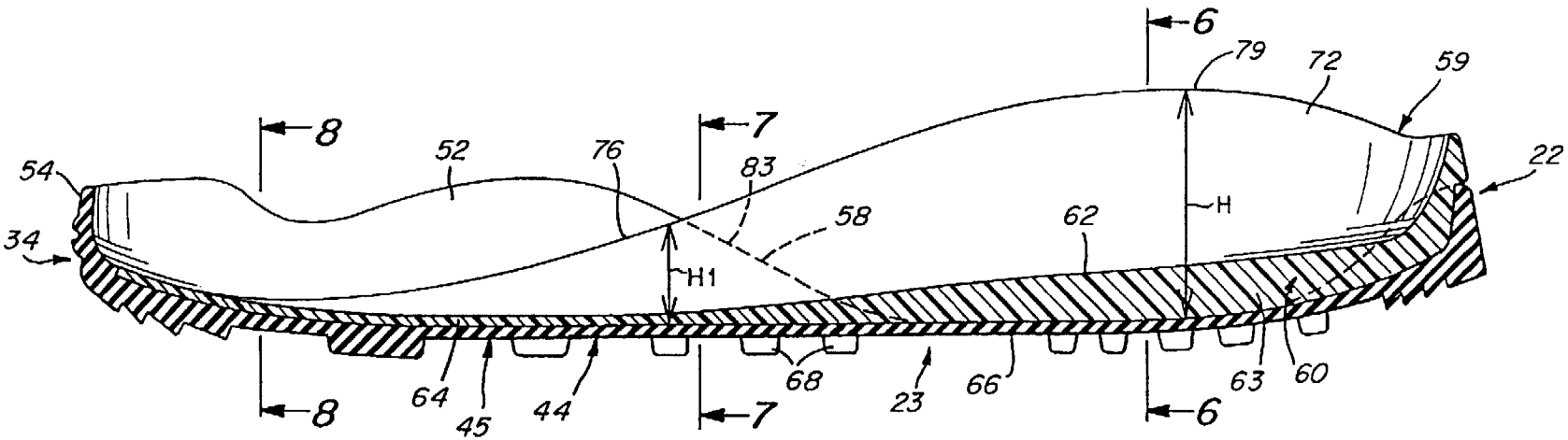
FIG. 5 is a partial exposed side view of the snowboarding boot.
Figure 9:
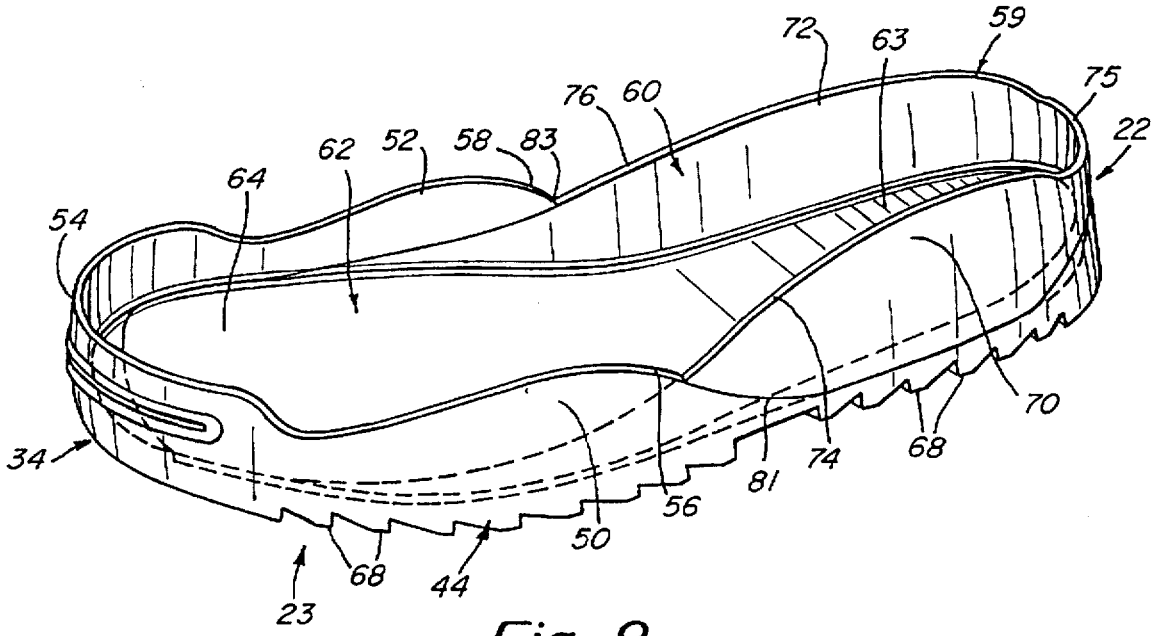
FIG. 9 is a perspective view of the sole structure for the snowboarding boot according to this invention.

With further reference to FIGS. 5 and 9, the sole 23 includes an outer sole 44 constructed from a conventional natural or synthetic rubber. The outer sole 44 includes a bottom 45 that contacts a snowboard (not shown) and includes sidewalls 50, 52 and 54 along the sides and toe, respectively. The sidewalls 50, 52 and 54 enhance the lateral support of the outer sole 44 and also form a larger surface of which adhesive can be applied to join the upper outer shell 26 to the sole 44.

The sidewalls 50 and 52 of the outer sole 44 end in a downward slope 56 and 58 at the approximate midpoint of the sole 44. The contour of the slope is chosen partially due to aesthetic concerns. The steepness of the slope, and the location of the joint between EVA and rubber sections is also based in part upon the amount of flexure desired at a given location along the sole. The EVA sidewalls resist flexure in rough proportion to their height. The exact joint and steepness can be chosen based upon a trial and error process in which the location is altered until a desired amount of flexure is obtained at a desired location along the sole.

A continuous raised heel sidewall 59 is provided by the midsole 60 according to this invention. The midsole 60, in this embodiment, is formed from a lightweight semi-rigid material such as ethyl vinyl acetate—EVA. The EVA, according to this embodiment, has significant cushioning properties, with a Durometer of between approximately 60 and 65. While EVA is preferred, another semi-rigid cushioning compound can be substituted such as polyurethane. The EVA midsole 60 includes a flattened, foot-supporting base section 62 formed as a wedge with a thick portion 63 adjacent the rear heel section 22 and a relatively thin front portion 64.

Figure 6:
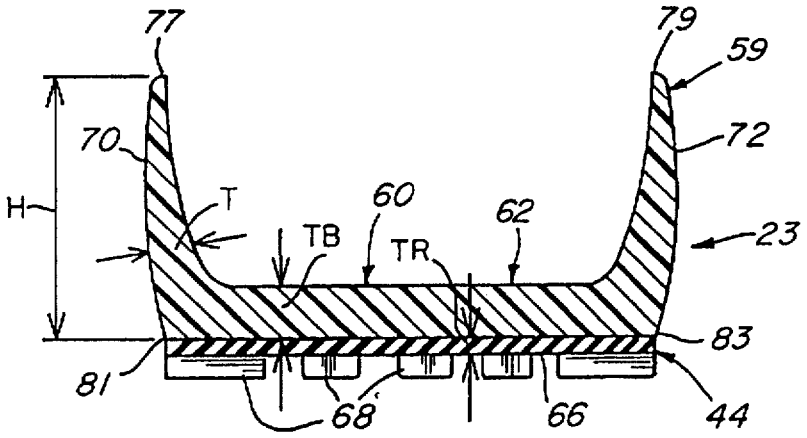
FIG. 6 is a partial rear cross-section taken along line 6—6 of FIG. 5.
Figure 7:
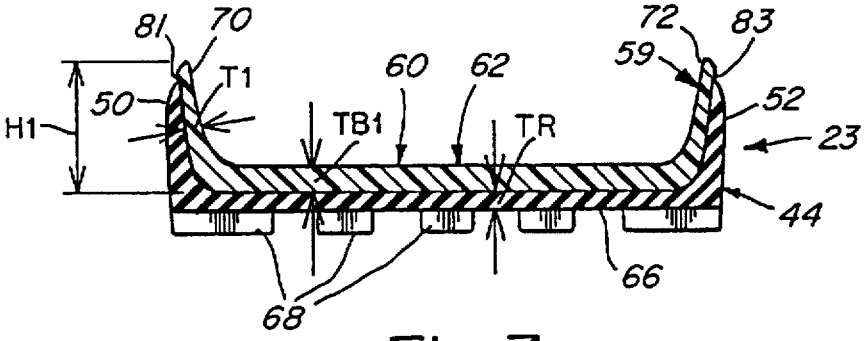
FIG. 7 is a partial rear cross-section taken along line 7—7 of FIG. 5.
Figure 8:
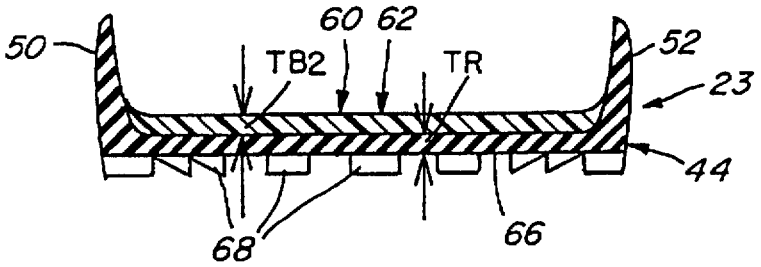
FIG. 8 is a partial rear cross-section taken along line 8—8 of FIG. 5.

The profile of the base section is shown at respective rear "heel", middle and front "toe" locations in cross-section in FIGS. 6–8. The thickness TR of the rubber outer sole base 66 is approximately ⅛ inch thick along the entire length of the boot. The treads 68 extend another ⅛–¼ inch below the base 66. At the heel (FIG. 6), the EVA of the base section 62 has a thickness TB of approximately ½ inch. At the approximate midpoint (FIG. 7), the thickness TB1 of the EVA is reduced to approximately ⅛ inch. At the front section (FIG. 8), where the base section 62 of the midsole has virtually no sidewalls, the thickness TB2 is approximately 3/16 inch.

A significant characteristic of the EVA midsole 60 is that it defines a continuous sidewall 59 with left and right semi-rigid sidewall sections 70 and 72, adjacent the heel portion of the boot. The left and right sidewalls 70 and 72 provide substantial lateral support in the important heel section of the boot for improved control. As detailed in FIG. 9, they can define gradual upward slopes 74 and 76 from the front portion 62 of the sole to maximum high points 77 and 79 at the heel (FIG. 6). They can gradually slope downwardly again to wrap around the heel 22, where they meet. At their maximum height (FIG. 6), the left and right sidewalls 70 and 72 have a height H of approximately 1⅞ inches according to this embodiment from the rubber sole base 66. They have a tapered thickness T that averages approximately ¼ inch. At the approximate midsection of the sole (FIG. 7), the sidewalls 70 and 72 have a height H1 relative to the rubber sole base 66 that is substantially shorter, at approximately ⅞ inch. The wall thickness T1 is, likewise, reduced to approximately ⅛ inch. The substantial reduction in EVA sidewall height and thickness at the midsection, and forward of the midsection, enables increased flexure at the front of the boot. The sidewalls 50 and 52 of the rubber outer sole 44, while more heavy, are also substantially more flexible, enabling the front of the boot to flex more easily about the ball of the foot. Therefore, it should be clear that the combined rubber outer sole 44 and midsole 60 of this embodiment provide a good balance between lightweight rigidity where needed at the heel and rugged flexible support where desired at the front.

Since the left and right sidewalls 70 and 72 of the EVA are formed integrally, the structure has significant strength and provides very good lateral support to the heel. The midsole forming process involves rough shaping of the EVA into a generalized outline of a sole. The rough shaped section is then pressed in a heated compression mold into a final shape. The compression molding process is conventional and yields a midsole with a tolerance of approximately ±2 mm.

The EVA midsole section 60 is molded so that its final shape conforms to that of the rubber outer sole 44. This conformance is visible in the continuous surface formed across the joint 81, 83 between the rubber sole sidewalls 50 and 52 and the EVA left and right sidewalls 70 and 72. In other words, the left and right combinations of sidewalls 50, 70 and 52, 72 join at respective seams 81 and 83 that give the approximate appearance of continuous sidewalls. Note, for example, in FIGS. 6 and 7 the relatively smooth transition at the seams 81 and 83 between the rubber outer sole 44 and the EVA midsole 60. The left and right sidewalls 70 and 72 of the EVA, in fact, nest within the sidewalls 50 and 52 of the rubber outer sole 44 around the midsection of the boot (see FIG. 7). This arrangement makes for a strong joint, due to the overlap of the EVA and rubber outer sole 44 and also leads to an aesthetically pleasing continuous surface shape where the sidewalls 50 and 52 of the rubber outer sole 44 gradually give way to the left and right sidewalls 70 and 72 of the EVA midsole 60.

The sidewall 70 and 72 join at the heel section 22. Where they join, the height of the rear sidewall 75 is reduced since the plurality of overlapping layers of leather-like material including the rear reinforcing layer 32 provides substantial back support. Thus, a high side wall at the heel section 22 may not be required, and its omission can serve to reduce weight.

In this embodiment, the EVA midsole is joined to the rubber sole 44 by a waterproof adhesive—preferably a polyurethane or methy ethyl ketone-based contact adhesive as described above. Likewise, the EVA sidewalls 70 and 72 are joined to the outer shell 26 of the upper 21 at the side leather sections 31 and the heel leather section 32 by the same adhesive. This embodiment requires no stitching and, thus, avoids a potential source of leakage common to prior art cup-sole arrangements.

Similarly, the adhesive can be used to join a covering layer 80, as detailed in FIG. 4, to the top of the EVA midsole 60. The covering layer can comprise a thin cardboard or fiberboard sheet having a thickness of approximately 3/32 inch, in this embodiment. Above this fiberboard covering layer 80 can be provided a conventional insole 82 constructed of polyurethane or similar foam or neoprene with an upper liner 84 formed from conventional synthetic socklining material. This insole 82 can be omitted. The inner boot or bladder 36 can be supported directly upon the covering layer 80 in an alternate embodiment.

The foregoing has been a detailed description of a preferred embodiment. Various modifications and equivalents can be made without departing from the spirit and scope of this invention. For example, the upper shown herein can be formed with a variety of materials, cut in a variety of patterns. The tread design can be varied to provide better board feel or better climbing ability as needed. The design and shape of the inner bladder can, likewise, be changed. Accordingly, this description is meant to be taken only by way of example and not to otherwise limit the scope of the invention.

What is claimed is:

1. A snowboarding boot comprising:

a snowboarding boot upper; and a snowboarding boot sole section joined to the snowboarding boot upper, the snowboarding boot sole section having a toe section and a heel section and including:

a resilient outersole extending substantially from the toe section to the heel section, the outersole including outersole sidewalls at the toe section that extend upwardly in engagement with the snowboarding boot upper, the outersole sidewalls having a height that decreases from the toe section towards the heel section; and a midsole constructed from a semi-rigid cushioning material joined to the outersole and including midsole sidewalls tat extend upwardly at the heel section in engagement with the snowboarding boot upper, the midsole sidewalls having a height that decreases from the heel section towards the toe section;

wherein the height of the midsole sideways is greater than the height of the outersole sidewalls adjacent the heel section and the height of the outersole sidewalls is greater than the height of the midsole sidewalls adjacent the toe section;

wherein the snowboarding boot upper and the snowboarding boot sole section are constructed and arranged to provide a snowboarding boot with the specific stiffness, flexibility and lateral support required for the sport of snowboarding.

2. The snowboarding boot as set forth in claim 1, wherein the midsole sidewalls and the outersole sidewalls join along an exposed seam line that forms a substantially continuous outer surface between the midsole sidewalls and the outersole sidewalls.

3. The snowboarding boot as set forth in claim 1, wherein the midsole includes a base constructed and arranged to support a foot and wherein the base has a thickness that decreases in a direction from the heel section to the toe section.

4. The snowboarding boot as set forth in claim 1, wherein at least a portion of the midsole sidewalls is enclosed by a portion of the outersole.

5. The snowboarding boot as set forth in claim 1, wherein the outer sole comprises rubber.

6. The snowboarding boot as set forth in claim 1, wherein the midsole comprises ethyl vinyl acetate.

7. The snowboarding boot as set forth in claim 1, wherein the outersole includes an outer surface and a plurality of treads disposed on the outer surface, the plurality of treads being constructed and arranged to provide traction.

8. The snowboarding boot as set forth in claim 1, wherein the midsole includes a base for supporting a foot, the base having a thickness that varies, in a direction taken from the heel section to the toe section, from approximately ½ inch to approximately 3/16 inch.

9. The snowboarding boot as set forth in claim 1, further comprising a bladder disposed within the snowboarding boot upper.

10. The snowboarding boot as set forth in claim 1, wherein the midsole sidewalls discontinue along a segment of the midsole at the toe section.

11. The snowboarding boot as set forth in claim 1, wherein the midsole sidewalls are stiffer than the outersole sidewalls.

12. The snowboarding boot as set forth in claim 1, wherein the outersole sidewalls discontinue along a segment of the outersole at the heel section.

13. The snowboarding boot as set forth in claim 1, wherein the midsole sidewalls wrap around the heel section.

14. The snowboarding boot as set forth in claim 1, wherein the snowboarding boot upper includes a stiffener that is constructed and arranged to stiffen at least a portion of the snowboarding boot upper.

15. A method for constructing a snowboarding boot having a toe section and a heel section, the method comprising the steps of:

providing a resilient snowboarding boot outersole including outersole sidewalls having a height that decreases from the toe section towards the heel section;

providing a snowboarding boot midsole constructed from a semi-rigid, lightweight material including at least a portion that extends upwardly in the form of midsole sidewalls having a height that decreases from the heel section towards the toe section, wherein the height of the midsole sidewalls is greater than the height of the outersole sidewalls adjacent the heel section and the height of the outersole sidewalls is greater than the height of the midsole sidewalls adjacent the toe section;

providing a snowboarding boot upper;

joining the snowboarding boot midsole to the snowboarding boot outersole so that the snowboarding boot midsole sidewalls extend upwardly from the snowboarding boot outersole;

joining the snowboarding boot upper to the snowboarding boot outersole; and joining the snowboarding boot upper to the snowboarding boot midsole;

wherein the snowboarding boot upper and the snowboarding boot outersole and midsole are constructed and arranged to provide a snowboarding boot with the specific stiffness, flexibility and lateral support required for the sport of snowboarding.

16. The method as set forth in claim 15, further comprising joining a portion of the midsole sidewalls and the outersole sidewalls along a seam line that forms a substantially continuous outer surface shape therebetween.

17. The method as set forth in claim 16 wherein the step of joining a portion of the sidewalls includes joining the outersole sidewalls and the midsole sidewalls along a seam line that slopes downwardly toward a bottom of the outersole in a direction taken from the toe to a heel section.

18. The method as set forth in claim 17, further comprising providing a midsole including midsole sidewalls that wrap around the heel section.

19. The method as set forth in claim 14, wherein the step of joining the midsole to the outersole and the step of joining the snowboarding boot upper to the midsole is free of applying stitching upon the midsole.

* * * * *

UNITED STATES PATENT AND TRADEMARK OFFICE

CERTIFICATE OF CORRECTION

PATENT NO. : 5,784,809
DATED : July 28, 1998
INVENTOR(S) : Steven C. McDonald

It is certified that error appears in the above-identified patent and that said Letters Patent is hereby corrected as shown below:

In claim 1, line 16, replace "tat" with --that--.
In claim 1, line 20, replace "sideways" with --sidewalls--.
In claim 19, line 1, replace "claim 14 with --claim 15--.

Signed and Sealed this

Twenty-ninth Day of September, 1998

*Attest:*

Bruce Lehman

BRUCE LEHMAN

*Attesting Officer*

*Commissioner of Patents and Trademarks*